US012708828B1

(12) United States Patent
Engel et al.

(10) Patent No.: US 12,708,828 B1
(45) Date of Patent: Aug. 18, 2026

(54) SYSTEMS AND METHODS FOR PROTECTIVE SCREEN

(71) Applicant: MLB Advanced Media, L.P., New York, NY (US)

(72) Inventors: Robert Engel, Livermore, CA (US); Paul Engel, Sunnyvale, CA (US)

(73) Assignee: MLB Advanced Media, L.P., New York, NY (US)

( * ) Notice: Subject to any disclaimer, the term of this patent is extended or adjusted under 35 U.S.C. 154(b) by 301 days.

(21) Appl. No.: 18/222,222

(22) Filed: Jul. 14, 2023

Related U.S. Application Data

(60) Provisional application No. 63/389,789, filed on Jul. 15, 2022.

(51) Int. Cl.
*A63B 71/02* (2006.01)
*A63B 102/18* (2015.01)

(52) U.S. Cl.
CPC ..... *A63B 71/022* (2013.01); *A63B 2102/18* (2015.10); *A63B 2102/182* (2015.10)

(58) Field of Classification Search
CPC ..... A63B 71/022; A63B 2102/18; A63B 2102/182
USPC ..... 473/421, 422, 446, 476–478, 454–456, 473/470, 471, 409; 273/398–402
See application file for complete search history.

(56) References Cited

U.S. PATENT DOCUMENTS

| | | | | |
|---|---|---|---|---|
| 6,402,641 | B1 * | 6/2002 | Lee | A63B 63/00 273/127 R |
| 6,695,724 | B2 * | 2/2004 | Birss | A63B 69/0024 273/392 |
| 6,899,645 | B1 * | 5/2005 | Hsiao | A63B 63/004 273/400 |
| 7,399,241 | B1 * | 7/2008 | Thomas, Sr. | A63B 69/0002 473/422 |
| 8,678,957 | B1 * | 3/2014 | Essex | A63B 71/022 473/456 |
| 11,213,731 | B1 * | 1/2022 | Anderson | A63B 63/004 |
| 2013/0157787 | A1 * | 6/2013 | Green | A63B 71/0619 473/454 |
| 2015/0018131 | A1 * | 1/2015 | Siefker | A63B 63/004 473/446 |

* cited by examiner

*Primary Examiner* — Nini F Legesse
(74) *Attorney, Agent, or Firm* — Leason Ellis LLP

(57) ABSTRACT

An improved protective barrier includes a stationary portion and a movable portion. The movable portion is configured to move between a first (e.g., open) and a second (e.g., closed) position. The movement may be in response to certain events taking place (e.g., the delivery and/or hitting of a baseball) and/or to regulate certain activity (e.g., to ensure that pitches are being delivered according to a particular cadence, such as, for example, not allowing a pitch to be delivered when a ball that has been hit remains in the air, or not allowing a pitch to be delivered before a certain amount of time has passed). A method of using the improved barrier includes placing the barrier in a closed position while a ball that has been hit remains in the air or until a certain amount of time has passed.

20 Claims, 8 Drawing Sheets

SYSTEMS AND METHODS FOR PROTECTIVE SCREEN

This application claims priority to provisional application No. 63/389,789, filed Jul. 15, 2022, the contents of which are hereby incorporated by reference in their entirety.

BACKGROUND

The present application relates generally to the field of protective barriers (e.g., screens) for use in sports environments. More particularly, the present application relates to protective barriers that include movable elements that may be manipulated during use.

During certain types of sporting events or practices, it may be desirable to provide a protective barrier (e.g., screen, fence, etc.) between players for safety or other reasons. For example, during a baseball batting practice, it may be desirable to have a barrier between a pitcher and a batter to provide some level of protection for the pitcher in relation to balls that are hit by the batter. Similar barriers may also be used in other situations (e.g., hitting exhibitions for baseball) or for other types of sports (e.g., tennis, lacrosse, etc.).

It would be advantageous to provide an enhanced barrier for use in sporting environments that has additional functionality, as will be described herein.

SUMMARY

According to an exemplary embodiment, a protective barrier (e.g., screen, fence, etc.) includes a fixed portion and a movable portion, where the movable portion may be moved from a first (e.g., open) position to a second (e.g., closed) position. Such movement may be manual or automated. In certain embodiments, the movement may be related to nearby activities. For example, the screen may be moved in response to a batter hitting a baseball thrown from behind the screen, or may be moved in response to other factors.

According to another exemplary embodiment, a protective screen includes a first portion and a second portion that is selectively repositionable relative to the first portion. The first portion includes a first frame and a first mesh (or netting). The first mesh is coupled to the first frame and is positioned within an area defined by the first frame. The second portion is selectively repositionable between a first (e.g., open) position and a second (e.g., closed) position. The second portion includes a second frame and a second mesh. The second mesh is coupled to the second frame and is positioned within an area defined by the second frame. The second portion is coupled to the first portion by a translation mechanism. The translation mechanism is coupled to the first frame and the second frame, where the translation mechanism is configured to permit translation of the second frame between the open position and the closed position.

In some embodiments, the translation mechanism is a rail provided horizontally along the first frame. The second frame may be provided within the rail, where the second portion is slidably repositionable between the open position and the closed position.

According to one specific exemplary embodiment, a method of controlling a screen includes moving a portion of a protective screen subsequent to the delivery of an object (e.g., a baseball). For example, when a ball is thrown from a pitcher toward a batter, the batter may either hit the ball or not. If the batter does not hit the ball, the screen may be allowed to remain in an open position. If the batter does hit the ball, the screen may be repositioned into a closed position. When the ball is hit, the ball can either remain in the air for an extended period of time or the ball can hit the ground. If the ball has not hit the ground, the screen may remain in the closed position. If the ball hits the ground, the screen may be repositioned into the open position. Once in the open position again, another ball may be thrown to the batter.

This summary is illustrative only and is not intended to be in any way limiting. Other aspects, inventive features, and advantages of the devices or processes described herein will become apparent in the detailed description set forth herein, taking in conjunction with the accompanying figures, wherein like reference numerals refer to like elements.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
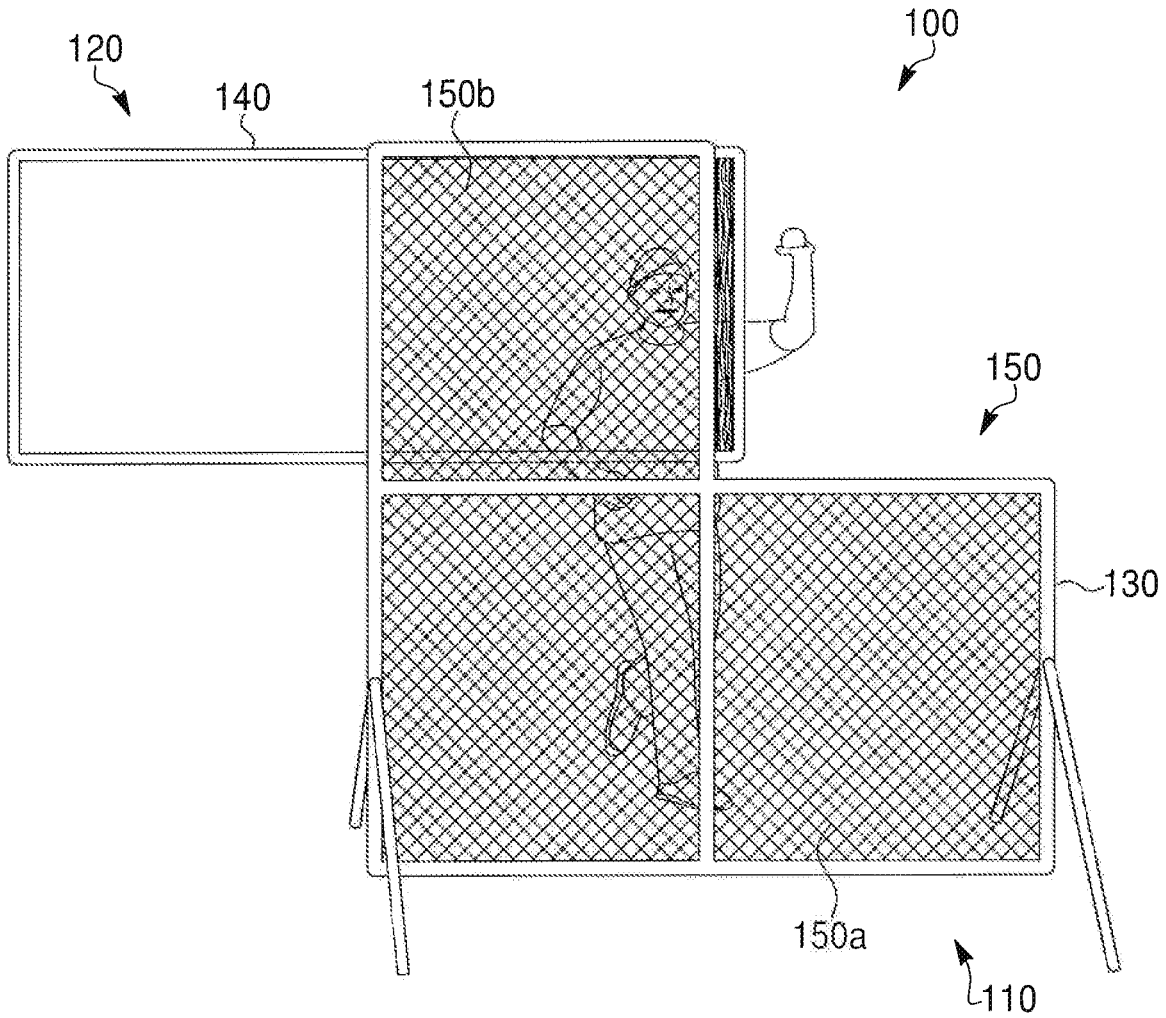
FIG. 1 shows a protective screen, shown in an open position, according to an exemplary embodiment.
Figure 2:
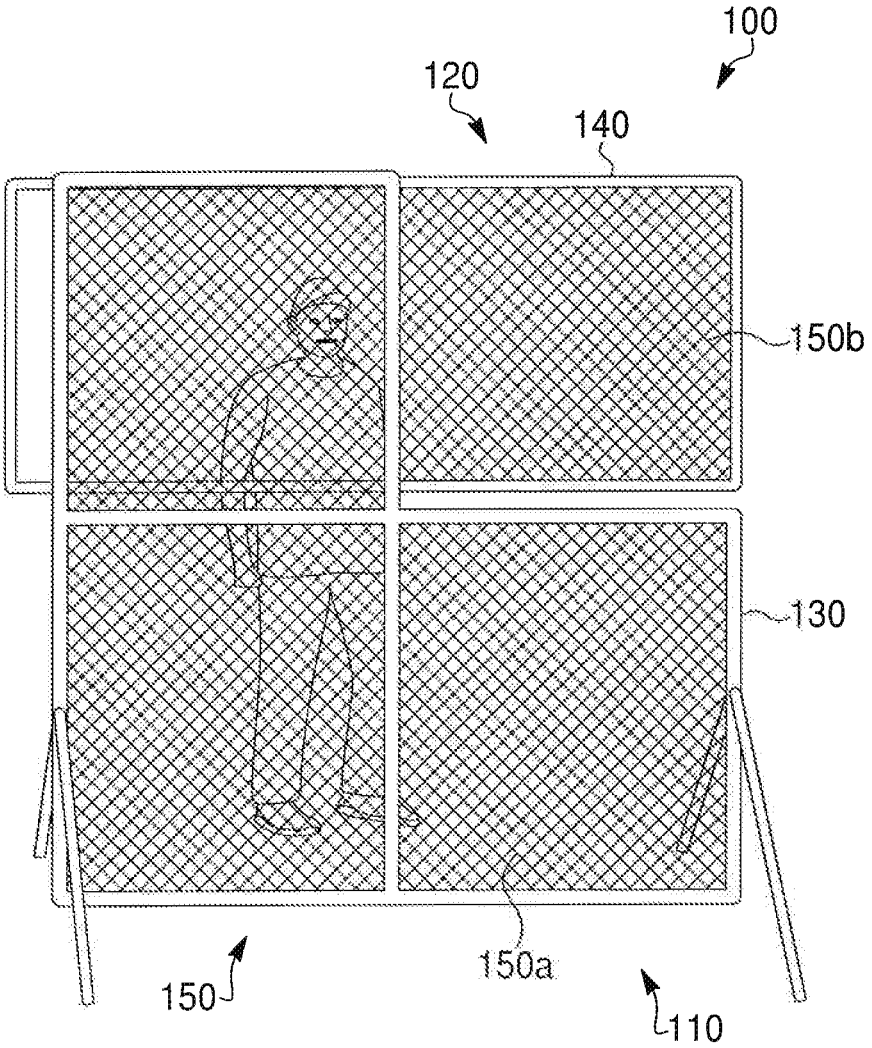
FIG. 2 shows the protective screen of FIG. 1, shown in a closed position, according to an exemplary embodiment.
Figure 3:
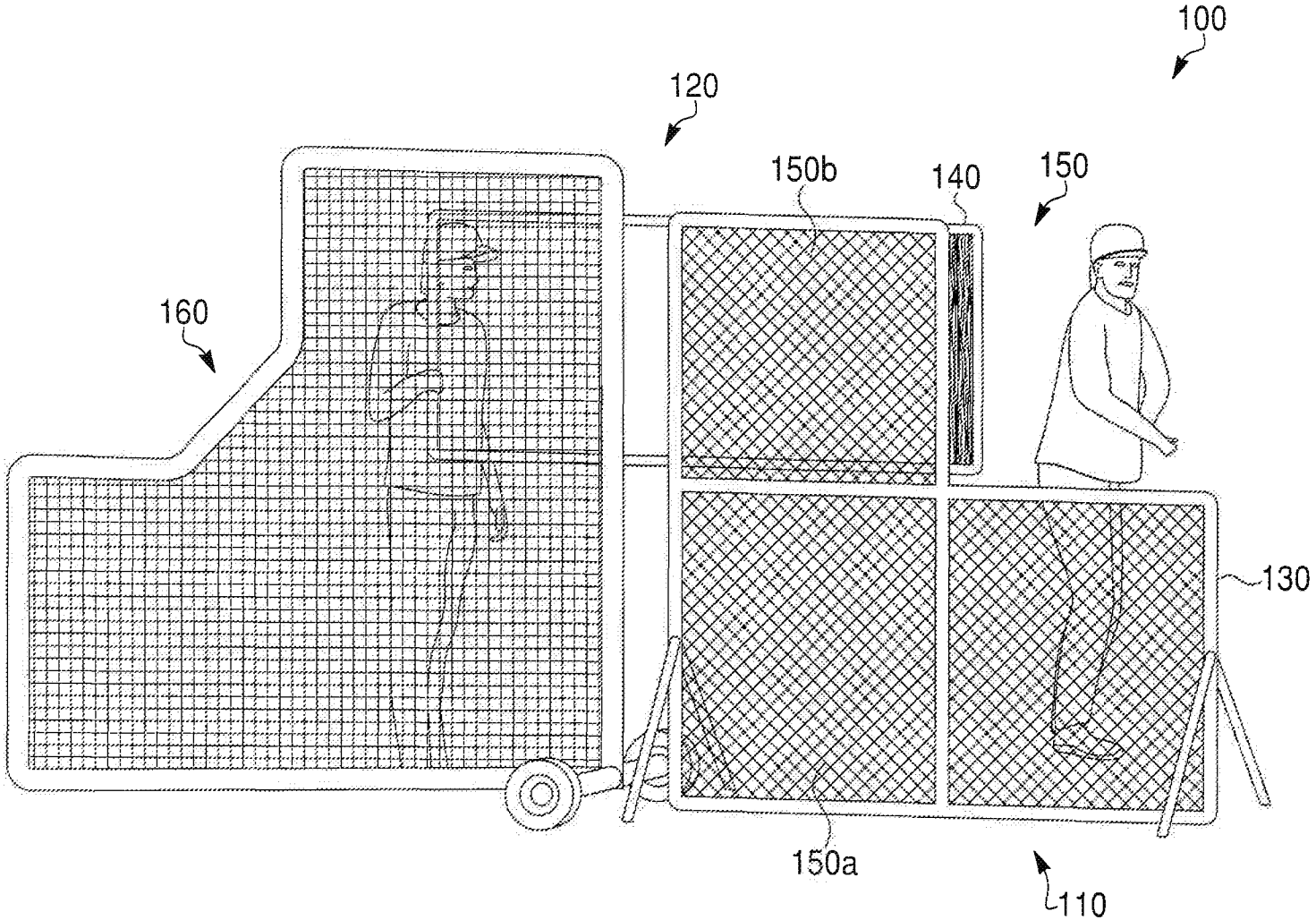
FIG. 3 shows the front of the protective screen of FIG. 1, shown in the open position, according to an exemplary embodiment.

Before turning to the FIGURES, which illustrate certain example embodiments in detail, it should be understood that the present disclosure is not limited to the details or methodology set forth in the description or illustrated in the figures. It should also be understood that the terminology used herein is for the purpose of description only and should not be regarded as limiting.

According to an exemplary embodiment, an improved protective barrier (e.g., screen, fence, etc.) includes a stationary portion and a movable portion. The movable portion is configured to move between a first (e.g., open) and a second (e.g., closed) position. The movement may be in response to certain events taking place (e.g., the delivery and/or hitting of a baseball) and/or to regulate certain activity (e.g., to ensure that pitches are being delivered according to a particular cadence, such as, for example, not allowing a pitch to be delivered when a ball that has been hit remains in the air, or not allowing a pitch to be delivered before a certain amount of time has passed).

In one specific example, a batting exhibition or competition known as a Home Run Derby may employ a protective barrier such as described in the present application. In a Home Run Derby competition, a batter attempts to hit as many home runs as they can in a fixed period of time. Although a pitcher may deliver a number of pitches in quick succession, this may result in a situation where multiple balls are hit in close succession by the batter, with several being in flight at the same time. This may result in challenges for viewers, officials, and the production crew to keep track of every ball in flight. It may therefore be advantageous to regulate the pitching in such an event to prevent multiple balls from being in flight simultaneously. For example, Major League Baseball has recently issued a rule that states the pitcher shall wait for a ball that has been hit to land (or hit the ground) before a subsequent pitch may be thrown. A protective barrier such as that described in the present application may allow for the pitches to be regulated or metered to help enforce such a rule.

Referring generally to the FIGURES, a barrier (e.g., screen, fence, etc.) 100 includes a first portion 110 and a second portion 120 that is selectively repositionable relative to the first portion. The first portion 110 includes a first frame 130 and a first mesh portion 150*a*, which may, for example, comprise netting or other material configured to block a ball that is hit by a batter. The first mesh portion 150*a* is coupled to the first frame 130 and is positioned within an area defined by the first frame. The second portion 120 is selectively repositionable between a first (e.g., open) position and a second (e.g., closed) position. The second portion includes a second frame 140 and a second mesh portion 150*b*. The second mesh portion 150*b* is coupled to the second frame 140 and is positioned within an area defined by the second frame 140. The second portion 120 is coupled to the first portion 110 by a translation mechanism. The translation mechanism is coupled to the first frame and the second frame, where the translation mechanism is configured to permit translation of the second frame between the open position and the closed position.

Referring generally to FIGS. 1-6, a protective screen, shield, or the like, shown as screen 100, is shown. The screen 100 may be used in sporting environments (e.g., baseball, football, tennis, lacrosse, etc.). According to one particular embodiment, the screen 100 may be used in baseball or softball pitching practice or exhibitions. Alternatively, the screen 100 may be used in other sports environments (e.g., football, soccer, tennis, etc.) and other applications outside of sports environments. In one particular application of a baseball or softball environment, a screen may be used to monitor and/or regulate the pitcher. Additionally or alternatively, the screen may be used to provide a barrier between the pitcher and a batter. In applications where the screen is used to regulate the pitcher, the screen may block, or otherwise prohibit, the pitcher from throwing a ball. Advantageously, this may provide added benefit to at least one of the pitcher, the batter, the officials, and the audience. In applications where the screen is used to provide a barrier between the pitcher and the batter, the screen may be positioned directly between them to provide an added level of protection from objects (e.g., baseballs, softballs, etc.) hit in a direction towards the pitcher.

The screen 100 may be positioned or located between a pitcher and a batter. The screen 100 may be configured to regulate the pitcher to prevent the pitcher from throwing a ball under certain conditions (e.g., a ball that is hit remains in the air, sufficient time has not passed between pitches, etc.). Additionally or alternatively, the screen 100 may provide a level of protection to the pitcher to prevent balls, hit towards the pitcher, from contacting the pitcher, gear, or additional individuals positioned behind the screen 100.

The screen 100 may include an L-shaped portion, shown as first portion 110, and a translation portion, shown as second portion 120. The screen 100 may have a rectangular geometry, where the first portion 110 defines an L-shaped structure and the second portion 120 defines a rectangular structure coupled to the L-shaped geometry to cooperatively define the rectangular geometry. In other embodiments, the screen 100 and the components thereof may have other configurations (e.g., shapes). The second portion 120 may be coupled to the first portion 110 proximate a top of the first portion 110. In other embodiments, the second portion 120 may be coupled to the first portion 110 in any position that would otherwise provide regulation to the pitcher and/or batter. As will be discussed in greater detail herein, the second portion 120 may be selectively repositionable between an open position and a closed position, relative to the first portion 110, to permit or prohibit the pitcher from throwing the ball.

The screen 100 may include one or more frames, shown as first frame 130 and second frame 140. The first frame 130 may define a frame structure for the first portion 110 and the second frame 140 may define a frame structure for the second portion 120. In other embodiments, the screen 100 may include a single frame, where the first portion 110 and the second portion 120 may be defined within the single frame. As shown in FIG. 1, the frames 130, 140 may be manufactured out of PVC material. In other embodiments, the frames 130, 140 may be manufactured out of any material that would be suitable as a frame (e.g., plastic, metal, carbon fiber, polymer, composite, etc.). Coupled between the frames 130, 140 may be a structure, mesh, screen, netting or the like, shown as mesh 150. The mesh 150 may extend within the frames 130, 140 provide a barrier between the pitcher and the batter. The mesh 150 may be manufactured out of nylon. In other embodiments, the mesh 150 may be manufactured out of any material suitable for a barrier (e.g., glass, plastic, plexi-glass, fiberglass, etc.).

The mesh 150 may include a first mesh portion 150*a* and a second mesh portion 150*b*. The first mesh portion 150*a* may be coupled to the first frame 130, and the second mesh portion 150*b* may be coupled to the second frame 140. In other embodiments, the mesh 150 may include a single portion coupled to both the first frame 130 and the second frame 140. The first mesh portion 150*a* may define a substantially similar geometry to the first frame 130 (e.g., L-shaped, etc.), and the second mesh portion 150*b* may define a substantially similar geometry to the second frame 140 (e.g., rectangular, etc.). The first mesh portion 150*a* may be provided within an area defined within the first frame 130, and the second mesh portion 150*b* may be provided within an area define within the second frame 140. For example, the first mesh portion 150*a* may be coupled to the first frame 130, where the first mesh portion 150*a* extends within the first frame 130 to provide a barrier between the batter and the pitcher.

In one example embodiment, the second mesh portion 150*b* may be coupled to the first frame 130 and the second frame 140. In such an example embodiment, the second mesh portion 150*b* may have a first end coupled to the first frame 130, and a second end coupled to the second frame 140. As can be appreciated, the first end may be the end provided centrally within the screen 100. Upon repositioning the second portion 120, the second end of the second mesh portion 150*b* is brought closer to the first end of the second mesh portion 150*b*. Accordingly, a portion of the second frame 140 that does not include the second mesh portion 150*b* is then provided without any mesh.

In another example embodiment, the second mesh portion 150*b* may be only coupled to the second frame 140. In such an example embodiment, the first and second ends of the second mesh portion 150*b* may be coupled to the second frame 140. As can be appreciated, the second mesh portion 150*b* may be coupled to all sides of the second frame 140 to create a tight mesh.

Figure 4:
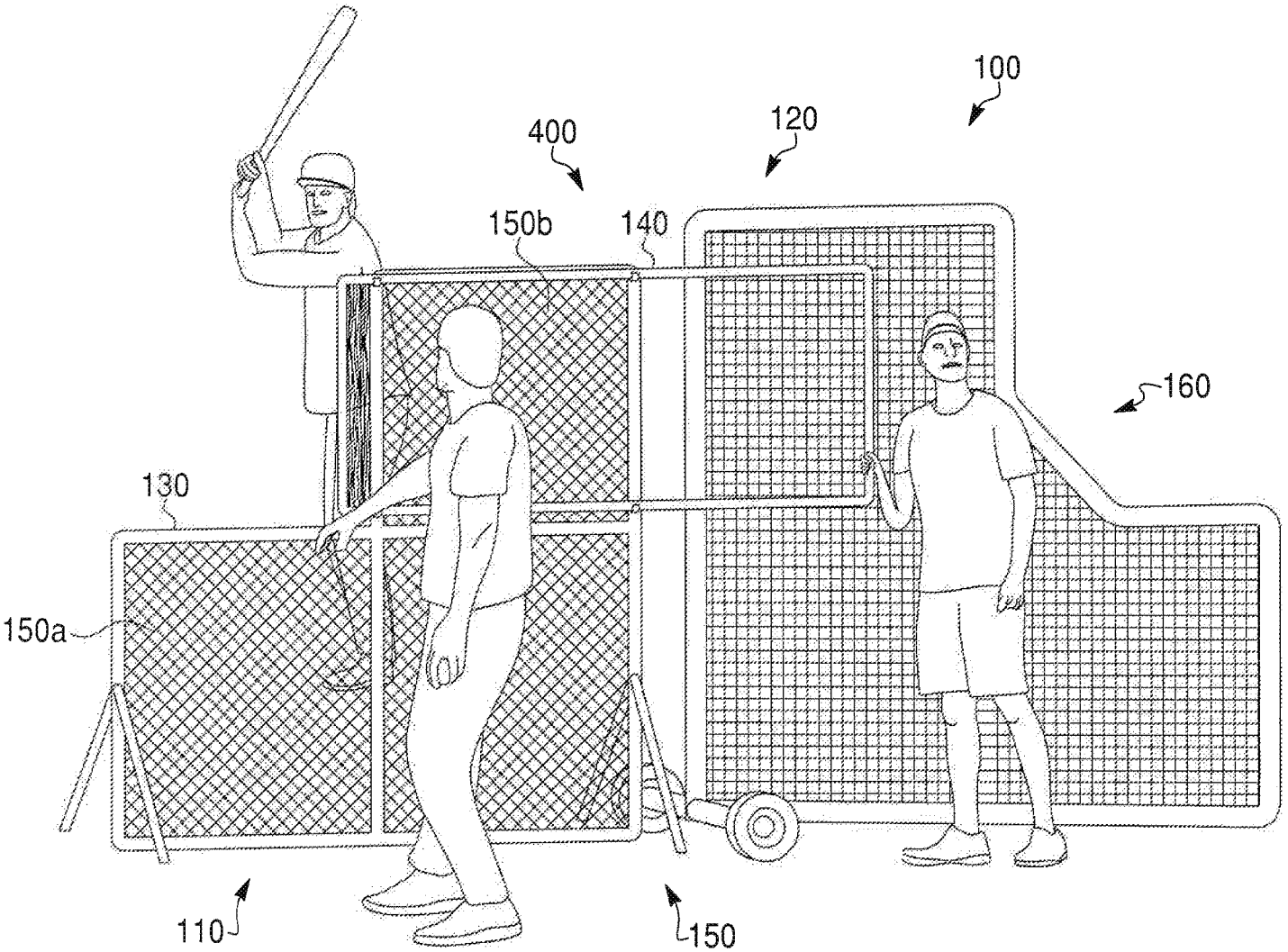
FIG. 4 shows the rear of the protective screen of FIG. 1, shown in the open position, according to an exemplary embodiment.
Figure 5:
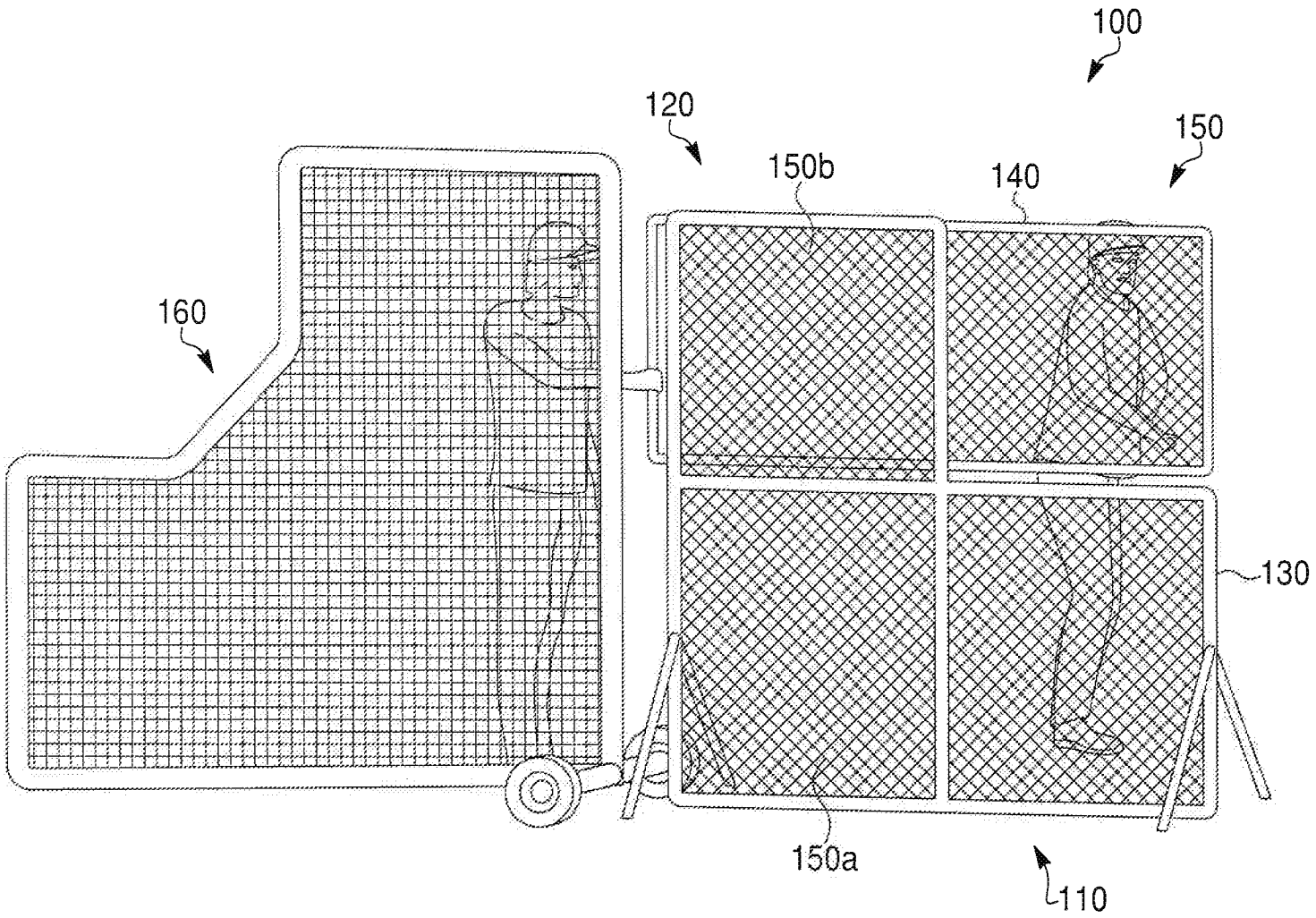
FIG. 5 shows the front of the protective screen of FIG. 1, shown in the closed position, according to an exemplary embodiment.
Figure 6:
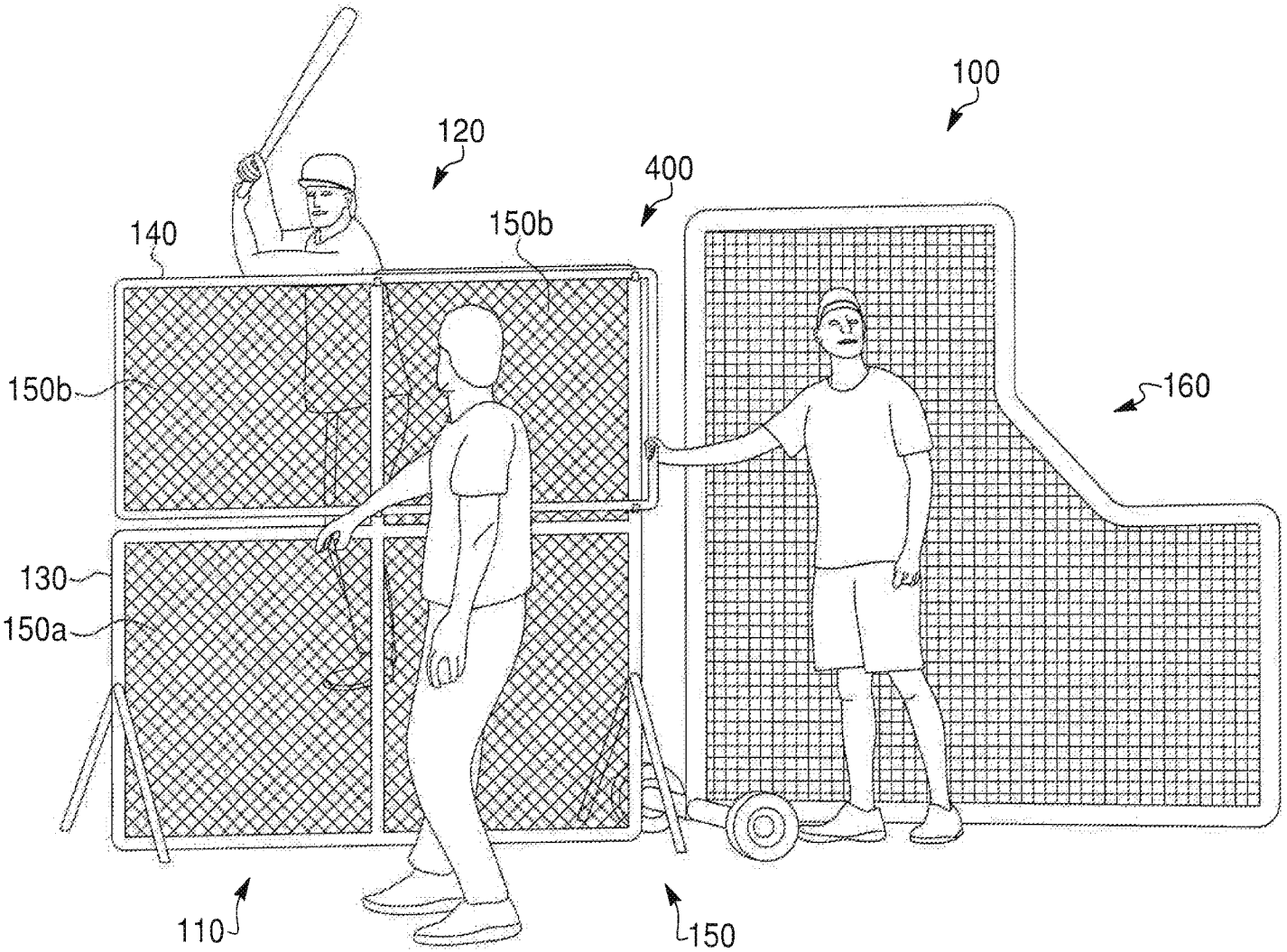
FIG. 6 shows the rear of the protective screen of FIG. 1, shown in the closed position, according to an exemplary embodiment.

As shown in FIGS. 4 and 6, the first frame 130 may be coupled to the second frame 140 via one or more translation mechanisms, pivoting mechanisms, joints, linkages, etc., shown as translation mechanism 400. The translation mechanism 400 may permit repositioning of the second portion 120 relative to the first portion 110. The translation mechanism 400 may be a mechanical mechanism, where the second portion 120 may be manually repositioned between the open position and the closed position. The screen 100 may include one or more translation mechanisms 400. For example, in one embodiment, the screen 100 may include one translation mechanism 400. In another example, in another embodiment, the screen 100 may include more than one translation mechanism 400 (e.g., one, two, three, four, five, six, seven, etc.). In one embodiment, the transition mechanism 400 may be positioned along a horizontal portion of the first frame 130, where the second portion 120 transitions along a horizontal axis defined by the horizontal transition mechanism 400. In another embodiment, the transition member 400 may be positioned along a vertical portion of the first frame 130, where the second portion 120 transitions along a vertical axis defined by the vertical transition member 400.

In one example embodiment, the translation mechanism 400 may be a rail. In such an example embodiment, the rail may be an integrated rail mechanism, sliding rail mechanism, guide rail, etc. for the second portion 120. The second portion 120 may be slidably provided within, or coupled to, the rail, where the second portion 120 slides between the open position and the closed position relative to the rail. According to an example embodiment, a user may provide a push and/or pull force to slide the second portion 120 between the open position and the closed position. In other embodiment, the second portion 120 may be repositioned between the open position and the closed position relative to the rail by a drive mechanism (e.g., motor and drive system, track, etc.). The rail may be configured to guide the second portion 120 between the open position and the closed position to prevent the second portion 120 from being out of position. For example, the rail may be configured to guide the second portion 120 along a contact plane to ensure the second portion 120 is fully positioned between the pitcher and the batter. The screen 100 may include multiple rails. The rails may be provided proximate to a top and a bottom of the second portion 120. The rails may extend along at least a portion of the first frame 130. For example, a first rail may be provided along a top portion of the first frame 130 and a second rail may be provided along a central portion of the first frame 130 proximate a location of the bottom of the second frame 140. The rail may be a continuous rail extending in a linear direction. In other embodiments, the rail may be a series of rails extending along a particular direction.

In other embodiments, the translation mechanism 400 may be a hinge. In such an example embodiment, the hinge may be an integrated hinge mechanism, spring-loaded hinge, barrel hinge, ball bearing hinge, offset hinge, etc. for the second portion 120. The second portion 120 may be rotatably coupled to the hinge, where the second portion 120 rotates between the open position and the closed positon relative to the hinge. The second portion 120 may rotate in a direction towards the pitcher, where the user repositioning the screen also includes a barrier between them and the batter. In other embodiments, the second portion 120 may rotate in a direction away from the pitcher, where the user may include an additional screen that is provided as a barrier between the user and the batter. According to an exemplary embodiment, the user may provide a push and/or pull force to rotate the second portion 120 between the open position and the closed position. The hinge may be configured to guide the second portion 120 between the open position and the closed position to prevent the second portion 120 from being out of positon. The hinge may be positioned along a vertical portion of the first frame 130, where the second portion 120 rotates relative to a vertical axis. In other embodiments, the hinge may be positioned along a horizontal portion of the first frame 130, where the second portion 120 rotates relative to a horizontal axis. When the second portion 120 is in the closed position, the screen 100 may include a catch (e.g., latch, lock, bumper, etc.) to hold the second portion 120 into the closed position. The catch may engage the second portion 120 to prevent the second portion 120 from repositioning when an external force is introduced onto the second portion 120 (e.g., when a ball hits the second portion 120, etc.).

In other embodiments, the translation mechanism 400 may be a linkage assembly. In such an example embodiment, the linkage assembly may be an integrated linkage assembly, a bar linkage assembly, etc. for the second portion 120. The second portion 120 may be at least one of rotatably and slidably coupled to the linkage assembly, where the second portion 120 may rotate and/or slide between the open position and the closed position relative to the linkage assembly. In other embodiments, the second portion 120 may both rotate and slide relative to the linkage assembly. According to an exemplary embodiment, the user may provide a push and/or pull force to rotate and/or slide the second portion 120 between the open position and the closed positon. The linkage assembly may be configured to guide the second portion 120 between the open positon and the closed positon to prevent the second portion 120 from being out of position. The linkage assembly may include a bracket and one or more linkages extending between the bracket and the second frame 140. The linkages may position the second portion 120 out and away from the first portion 110 to provide a space between the first portion 110 and the second portion 120. The additional space may be useful in applications where the screen 100 includes a device provided between the first portion 110 and the second portion 120, to prohibit the second portion 120 from coming in contact with the device when repositioning between the closed position and the open position. The linkage assembly may include a catch (e.g., detent, bumper, etc.) that engages the second portion 120 when the second portion 120 is in the closed position. The catch may maintain the second portion 120 in the closed position when an external force is applied to the second portion (e.g., when a ball hits the second portion 120).

Figure 8:
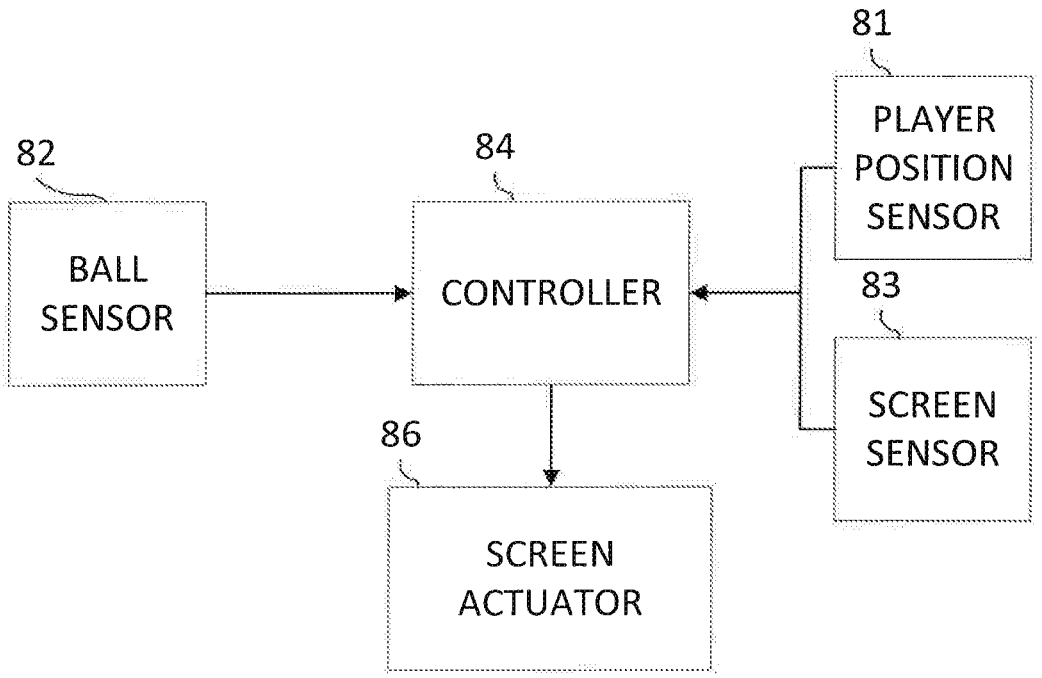
FIG. 8 is a block diagram illustrating a control system for operating the protective screen according to an exemplary embodiment.

In other embodiments, the translation mechanism 400 may be an automatic mechanism, where the second portion 120 may be automatically repositioned between the open position and the closed position (e.g., motor, drive system, track, etc.). In such an embodiment, the screen 100 may include a control system that is configured to selectively reposition the second portion 120 in response to receiving a feedback (e.g., sensor data, etc.). The control system may include one or more sensors (e.g., position sensors, motion sensors, LIDAR sensors, etc.) that detect a position of at least one of the pitcher, the ball, or the screen 100. The sensors may send a feedback to the control system to determine a status of the pitcher, the ball, or the screen. In response to receiving the status, the control system may determine a theoretical position of the screen 100 and an actual position of the screen 100. If the theoretical position and actual position of the screen 100 do not match, the control system may send a command to the screen 100 to reposition the screen 100. That is, the control system may send a command to the translation mechanism 400 to reposition the screen 100. Alternatively, the control system may be operably coupled to a controller, where a user interacts with a signal (e.g., switch, button, voice command, etc.) to reposition the screen 100. In such an embodiment, the controller may be wirelessly coupled to the control system, where the user can be positioned distal the screen 100. Such a system is illustrate in FIG. 8, which is a block diagram in which one or more sensors 82 are used to determine the position/motion of the ball, one or more sensors 81 determine position/motion of a player (e.g., the pitcher), and one or more sensors determine the status/position of the screen 100 (i.e., whether open or closed). Sensor data is provided to a controller which sends commands to an actuator (e.g., a motor) to open or close the screen 100.

Figure 7:
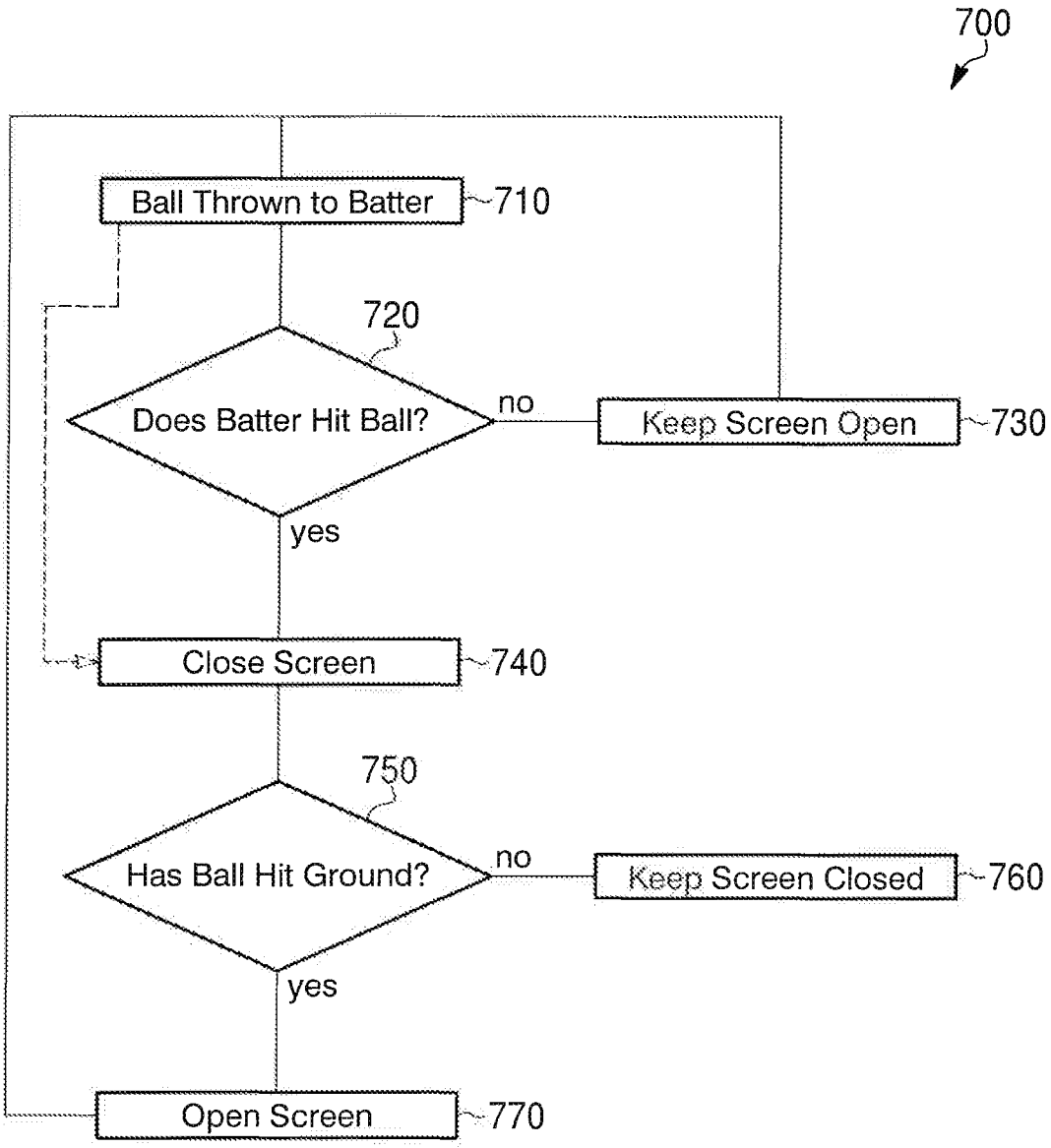
FIG. 7 shows a method of controlling diagram of the protective screen of FIG. 1, according to an exemplary embodiment.

Referring now to FIG. 7, a method 700 of controlling the screen 100 is shown, according to one example embodiment. The method 700 may be a continuous method that extends along a duration of an event (e.g., sporting event, exhibition event, practice event, etc.). The method 700 may include a step 710 of throwing a ball to a batter. The pitcher, positioned behind the screen 100, may throw the ball to the batter, where the batter is positioned on another side of the screen. In other embodiments, a machine may throw the ball to the batter, where the machine is positioned behind the screen 100.

The method 700 includes a step 720. The step 720 may be a first decision point in the method 700. At step 720, a user determines if the batter hits the ball. If the batter did not hit the ball, the method 700 goes to step 730, where the user keeps the screen 100 into the open position. When the method reaches step 730, the method 700 restarts at step 710. If the batter did hit the ball, the method 700 goes to step 740, where the user repositions the second portion 120 into the closed position.

In other embodiments, the screen 100 may include a sensor system that detects a status of the ball (e.g., motion, location, etc.). In such an embodiment, as described above, when the sensor system detects that the ball has left the pitcher, the sensor system may send a status back to a control system, where the control system sends a command to reposition the second portion 120.

Additionally or alternatively, the user may reposition the second portion 120 into the closed position, once the ball is thrown to the batter. In such an example, upon release of the ball, the user may close the second portion 120. The second portion 120 may be repositioned into the closed position before the ball reaches the batter, at the same time the ball reaches the batter, or after the batter ball reaches the batter (e.g., the batter has hit the ball, the ball has been thrown past the batter, etc.). As can be appreciated, repositioning the second portion 120 after the pitcher releases the ball provides an extra barrier between the pitcher and the batter.

The method includes a step 750. The step 750 may be a second decision point in the method 700. At step 750, the user determines when the ball has hit the ground. In other embodiment, a control system may determine when the ball has hit the ground. If the ball has not hit the ground yet, the method 700 goes into step 760, where the user keeps the second portion 120 in the closed position. If the ball has hit the ground, the method 700 goes to step 770, where the user repositions the second portion 120 into the open position. Once the method 700 has reached step 770, the method 700 restarts at step 710. The method 700 may repeat the cycle continuously for every batter or until the event has ended. As can be appreciated, the user may then regulate a pace at which the pitcher throws the ball to the batter.

Although the screen 100 is described above as being for use in a baseball/softball environment, it can be appreciated that the screen 100 may also be used in alternate environments (e.g., tennis, football, basketball, etc.). In a tennis environment, the screen 100 may be utilized as a barrier between a player and another individual (e.g., another player, official, coach, etc.), where the individual may stand behind the screen 100 to monitor the player. In a football environment, the screen 100 maybe utilized between a kicker and another individual (e.g., another player, official, coach, etc.), where the kicker may be regulated on a pace of kicking the football. In a basketball environment, the screen 100 may be utilized as a barrier between a player and another individual (e.g., another player, official, coach, etc.), where the player may be regulated on a pace of shooting the basketball. As can be appreciated, the screen 100 may operate the same for all sports environments.

As utilized herein, the terms "approximately," "relative to," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the screen 100 and the systems and components thereof as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A protective barrier comprising:

a first fixed screen portion having a first frame and a first mesh positioned within an area defined by the first frame;

a second screen portion having a second frame and a second mesh positioned within an area defined by the second frame; and a translation mechanism coupled to the first frame and the second frame, the translation mechanism configured to permit translation of the second frame relative to the first frame from an open position to a closed position;

wherein the open position permits a ball to be thrown from a first side of the protective barrier to an opposing side of the protective barrier; and wherein the closed position prohibits the ball to be thrown from the first side of the protective barrier to the opposing side.

2. The protective barrier of claim 1, wherein the translation mechanism includes a rail configured to facilitate movement of the second screen portion between the closed position and the open position.

3. The protective barrier of claim 1, wherein the translation mechanism includes a motor configured to facilitate movement of the second screen portion between the closed position and the open position.

4. The protective barrier of claim 1, further comprising a control system configured to facilitate movement of the second screen portion between the closed position and the open position in response to sensor data, wherein the sensor data comprises at least one of: a detected position of the ball, movement of the ball, movement of a pitcher, or movement of the second screen portion.

5. The protective barrier of claim 1, wherein the control system is configured to facilitate movement of the second screen portion between the closed position and the open position based on whether the ball is detected to have hit a ground surface.

6. A method of controlling a protective barrier having a first screen portion and a second screen portion movable between an open position that permits a ball to be thrown over the first screen portion and from a first side of the protective barrier to an opposing side of the protective barrier and a closed position that prohibits the ball to be thrown over the first screen portion and from the first side of the protective barrier to the opposing side, the method comprising:

moving the second screen portion to the open position without moving the first screen portion; and after the ball has been hit, moving the second screen portion to the closed position without moving the first screen portion.

7. The method of claim 6, wherein the second screen portion is moved to the closed position after the ball has been hit and then the second screen portion is moved to the open position after the ball has hit a ground surface.

8. The method of claim 6, wherein the second screen portion is moved to the closed position after the ball has been hit and then the second screen portion is moved to the open position after a predetermined amount of time has elapsed.

9. A protective barrier comprising:

a first screen portion comprising:

a first frame, and a first screen coupled to the first frame;

a second screen portion comprising:

a second frame, and a second screen coupled to the second frame;

a translation mechanism coupled to the first frame and the second frame, the translation mechanism configured to facilitate repositioning of the second screen portion relative to the first screen portion between a first position and a second position, the second screen overlapping at least a portion of the first screen when the second screen portion is in the first position, and at least a portion of the second screen extending above at least a portion of the first screen when the second screen portion is in the first position.

10. The protective barrier of claim 9, wherein the first frame borders an L-shaped opening.

11. The protective barrier of claim 10, wherein the second frame borders a rectangular opening.

12. The protective barrier of claim 11, wherein:

the first frame has a first width; and the second frame has a second width that is equal to the first width.

13. The protective barrier of claim 11, wherein:

the first frame has a first height; and the second frame has a second height that is less than the first height.

14. The protective barrier of claim 13, wherein:

the first frame has a first width; and the second frame has a second width that is equal to the first width.

15. The protective barrier of claim 14, wherein the translation mechanism is configured to facilitate repositioning of the second screen portion relative to the first screen portion via linear translation of the second screen portion relative to the first screen portion.

16. The protective barrier of claim 15, wherein the first frame borders an L-shaped opening.

17. The protective barrier of claim 16, wherein the second frame borders a rectangular opening.

18. The protective barrier of claim 9, wherein the translation mechanism is configured to facilitate repositioning of the second screen portion relative to the first screen portion via linear translation of the second screen portion relative to the first screen portion.

19. The protective barrier of claim 9, further comprising a leg coupled to the first frame, the leg configured to support the protective barrier on a ground surface so that the first frame is perpendicular to the ground surface.

20. The protective barrier of claim 9, wherein at least a portion of the first screen extends below at least a portion of the second frame in the first position and the second position.

* * * * *